US006568487B2

(12) United States Patent
Meister et al.

(10) Patent No.: US 6,568,487 B2
(45) Date of Patent: May 27, 2003

(54) METHOD FOR FAST AND EXTENSIVE FORMATION EVALUATION USING MINIMUM SYSTEM VOLUME

(75) Inventors: Matthias Meister, Celle (DE); Sven Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/910,624

(22) Filed: Jul. 20, 2001

(65) Prior Publication Data

US 2002/0060094 A1 May 23, 2002

Related U.S. Application Data

(63) Continuation-in-part of application No. 09/621,398, filed on Jul. 21, 2000, now Pat. No. 6,478,096.
(60) Provisional application No. 60/219,741, filed on Jul. 20, 2000.

(51) Int. Cl.[7] ..... E21B 49/08
(52) U.S. Cl. ..... 175/50; 175/236; 166/100; 166/250.01
(58) Field of Search ..... 175/40, 48, 50, 175/231, 233, 236; 166/100, 250.11, 250.02, 250.07, 250.09, 250.17; 73/152.26

(56) References Cited

U.S. PATENT DOCUMENTS 4,287,946 A * 9/1981 Brieger ..... 166/100
4,416,152 A * 11/1983 Wilson ..... 73/152.26
4,483,187 A * 11/1984 Maddock, Jr. et al. ... 73/152.29
4,745,802 A * 5/1988 Purfurst ..... 73/152.26
4,860,580 A * 8/1989 DuRocher ..... 73/152.26
4,951,749 A * 8/1990 Carroll ..... 166/264
5,233,866 A 8/1993 Desbrandes
5,587,525 A 12/1996 Shwe et al.
5,644,076 A 7/1997 Proett et al.
5,703,286 A 12/1997 Proett et al.
5,708,204 A 1/1998 Kasap ..... 73/152.52
5,803,186 A 9/1998 Berger et al.
6,047,239 A * 4/2000 Berger et al. ..... 702/9

FOREIGN PATENT DOCUMENTS

EP 0698722 A2 2/1996

* cited by examiner

*Primary Examiner*—Frank Tsay
(74) *Attorney, Agent, or Firm*—Madan, Mossman & Sriram, P.C.

(57) ABSTRACT

A minimum volume apparatus and method is provided including a tool for obtaining at least one parameter of interest of a subterranean formation in-situ, the tool comprising a carrier member, a selectively extendable member mounted on the carrier for isolating a portion of annulus, a port exposable to formation fluid in the isolated annulus space, a piston integrally disposed within the extendable member for urging the fluid into the port, and a sensor operatively associated with the port for detecting at least one parameter of interest of the fluid.

14 Claims, 9 Drawing Sheets

METHOD FOR FAST AND EXTENSIVE FORMATION EVALUATION USING MINIMUM SYSTEM VOLUME

CROSS REFERENCE TO RELATED APPLICATIONS

The present application is a continuation-in-part of U.S. patent application Ser. No. 09/621,398 filed on Jul. 21, 2000, now U.S. Pat. No. 6,478,096, the specification of which is incorporated herein by reference, and is related to U.S. provisional patent application Ser. No. 60/219,741 filed on Jul. 20, 2000, the specification of which is incorporated herein by reference.

BACKGROUND OF THE INVENTION

1. Field of the Invention

This invention generally relates to the testing of underground formations or reservoirs. More particularly, this invention relates to a reduced volume method and apparatus for sampling and testing a formation fluid using multiple regression analysis.

2. Description of the Related Art

To obtain hydrocarbons such as oil and gas, well boreholes are drilled by rotating a drill bit attached at a drill string end. The drill string may be a jointed rotatable pipe or a coiled tube. A large portion of the current drilling activity involves directional drilling, i.e., drilling boreholes deviated from vertical and/or horizontal boreholes, to increase the hydrocarbon production and/or to withdraw additional hydrocarbons from earth formations. Modern directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations.

One type of while-drilling test involves producing fluid from the reservoir, collecting samples, shutting-in the well, reducing a test volume pressure, and allowing the pressure to build-up to a static level. This sequence may be repeated several times at several different reservoirs within a given borehole or at several points in a single reservoir. This type of test is known as a "Pressure Build-up Test." One important aspect of data collected during such a Pressure Build-up Test is the pressure build-up information gathered after drawing down the pressure in the test volume. From this data, information can be derived as to permeability and size of the reservoir. Moreover, actual samples of the reservoir fluid can be obtained and tested to gather Pressure-Volume-Temperature data relevant to the reservoir's hydrocarbon distribution.

Some systems require retrieval of the drill string from the borehole to perform pressure testing. The drill string is removed, and a pressure measuring tool is run into the borehole using a wireline tool having packers for isolating the reservoir. Although wireline conveyed tools are capable of testing a reservoir, it is difficult to convey a wireline tool in a deviated borehole.

The amount of time and money required for retrieving the drill string and running a second test rig into the hole is significant. Further, when a hole is highly deviated wireline conveyed test figures cannot be used because frictional force between the test rig and the wellbore exceed gravitational force causing the test rig to stop before reaching the desired formation.

A more recent system is disclosed in U.S. Pat. No. 5,803,186 to Berger et al. The '186 patent provides a MWD system that includes use of pressure and resistivity sensors with the MWD system, to allow for real time data transmission of those measurements. The '186 device enables obtaining static pressures, pressure build-ups, and pressure draw-downs with a work string, such as a drill string, in place. Also, computation of permeability and other reservoir parameters based on the pressure measurements can be accomplished without removing the drill string from the borehole.

Using a device as described in the '186 patent, density of the drilling fluid is calculated during drilling to adjust drilling efficiency while maintaining safety. The density calculation is based upon the desired relationship between the weight of the drilling mud column and the predicted downhole pressures to be encountered. After a test is taken a new prediction is made, the mud density is adjusted as required and the bit advances until another test is taken.

A drawback of this type of tool is encountered when different formations are penetrated during drilling. The pressure can change significantly from one formation to the next and in short distances due to different formation compositions. If formation pressure is lower than expected, the pressure from the mud column may cause unnecessary damage to the formation. If the formation pressure is higher than expected, a pressure kick could result. Consequently, delay in providing measured pressure information to the operator may result in drilling mud being maintained at too high or too low a density.

Another drawback of the '186 patent, as well as other systems requiring large fluid intake, is that system clogging caused by debris in the fluid can seriously impede drilling operations. When drawing fluid into the system, cuttings from the drill bit or other rocks being carried by the fluid may enter the system. The '186 patent discloses a series of conduit paths and valves through which the fluid must travel. It is possible for debris to clog the system at any valve location, at a conduit bend or at any location where conduit size changes. If the system is clogged, the tool must be retrieved from the borehole for cleaning causing delay in the drilling operation. Therefore, it is desirable to have an apparatus with reduced risk of clogging.

Another drawback of the '186 patent is that it has a large system volume. Filling a system with fluid takes time, so a system with a large internal volume requires more time for the system to respond during a drawdown cycle. Therefore it is desirable to have a small internal system volume in order to reduce sampling and test time.

SUMMARY OF THE INVENTION

The present invention addresses some of the drawbacks discussed above by providing a measurement while drilling apparatus and method which enables sampling and measurements of parameters of fluids contained in a borehole while reducing the time required for taking such samples and measurements and reducing the risk of system clogging.

One aspect of the present invention provides a method for determining a parameter of interest of a formation while drilling. The method comprises conveying a tool on a drill string into a borehole traversing the formation and extending at least one selectively extendable probe disposed on the tool to make sealing engagement with a portion of the formation. A port is exposed to the sealed portion of the formation, the port providing fluid communication between the formation and a first volume within the tool. The first volume is varied with a volume control device using a plurality of volume change rates. The method includes determining at least one characteristic of the first volume using a test device at least twice during each of the plurality of volume change rates, and using multiple regression analysis to determine the formation parameter of interest using the at least one characteristic determined during the plurality of volume change rates.

Another aspect of the present invention provides a method for determining a parameter of interest of a formation while drilling. The method comprises conveying a tool on a drill string into a borehole traversing the formation and extending at least one selectively extendable probe disposed on the tool to make sealing engagement with a portion of the formation. A port is exposed to the sealed portion of the formation, the port providing fluid communication between the formation and a first volume within the tool, the first volume being selectively variable between zero cubic centimeters and 1000 cubic centimeters. The first volume is varied with a volume control device using a plurality of volume change rates. The method includes determining at least one characteristic of the first volume using a test device at least twice during each of the plurality of volume change rates, and determining the formation parameter of interest using the at least one sensed characteristic sensed during the plurality of volume change rates.

The novel features of this invention, as well as the invention itself, will be best understood from the attached drawings, taken along with the following description, in which similar reference characters refer to similar parts.

DESCRIPTION OF PREFERRED EMBODIMENTS

Figure 1:
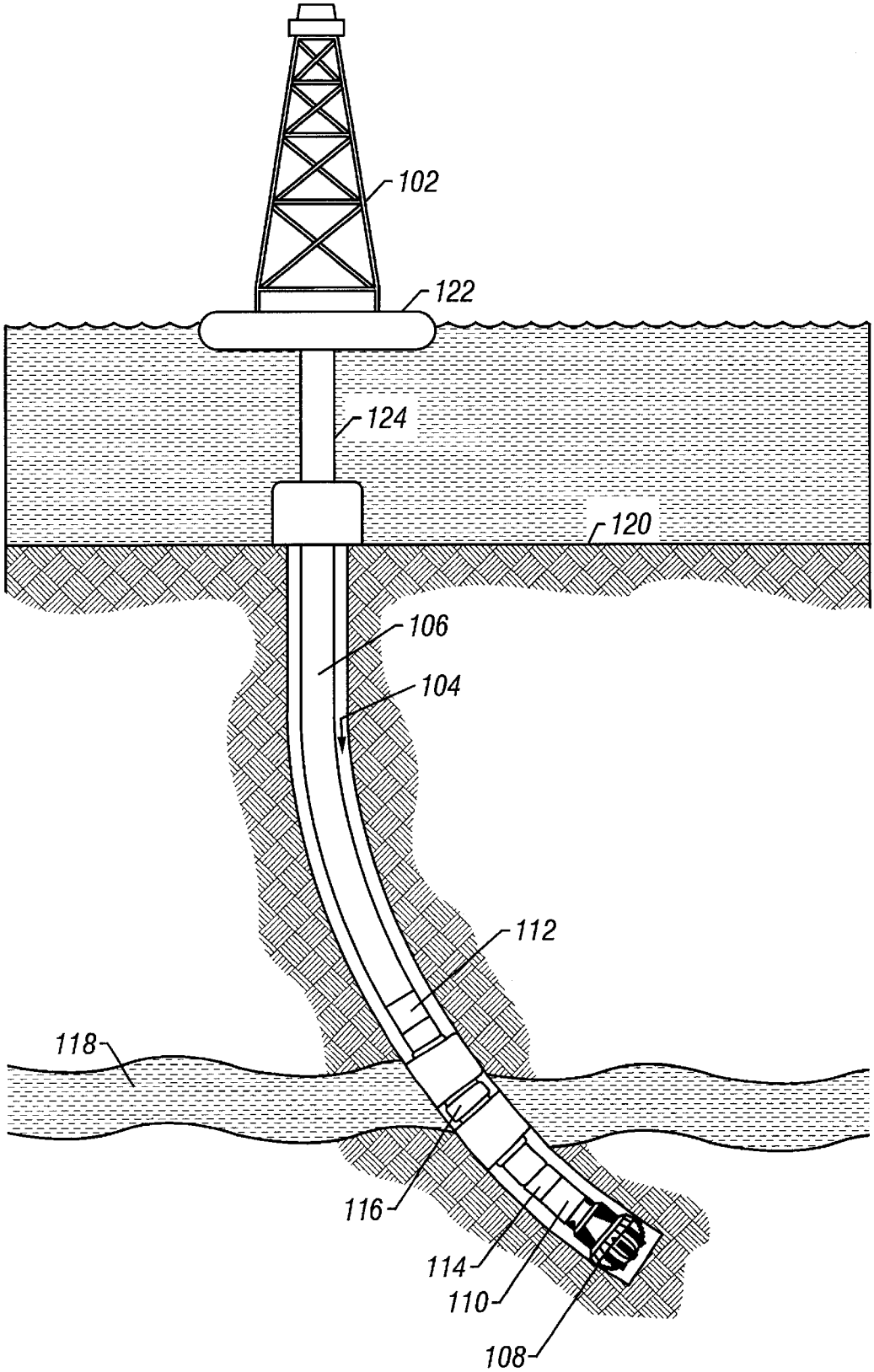
FIG. 1 is an elevation view of an offshore drilling system according to one embodiment of the present invention.

FIG. 1 is a typical drilling rig 102 with a borehole 104 being drilled into subterranean formations 118, as is well understood by those of ordinary skill in the art. The drilling rig 102 has a drill string 106. The present invention may use any number of drill strings, such as, jointed pipe, coiled tubing or other small diameter work string such as snubbing pipe. The drill string 106 has attached thereto a drill bit 108 for drilling the borehole 104. The drilling rig 102 is shown positioned on a drilling ship 122 with a riser 124 extending from the drilling ship 122 to the sea floor 120.

If applicable, the drill string 106 can have a downhole drill motor 110 for rotating the drill bit 108. Incorporated in the drill string 106 above the drill bit 108 is at least one typical sensor 114 to sense downhole characteristics of the borehole, the bit, and the reservoir. Typical sensors sense characteristics such as temperature, pressure, bit speed, depth, gravitational pull, orientation, azimuth, fluid density, dielectric, etc. The drill string 106 also contains the formation test apparatus 116 of the present invention, which will be described in greater detail hereinafter. A telemetry system 112 is located in a suitable location on the drill string 106 such as uphole from the test apparatus 116. The telemetry system 112 is used to receive commands from, and send data to, the surface.

Figure 2:
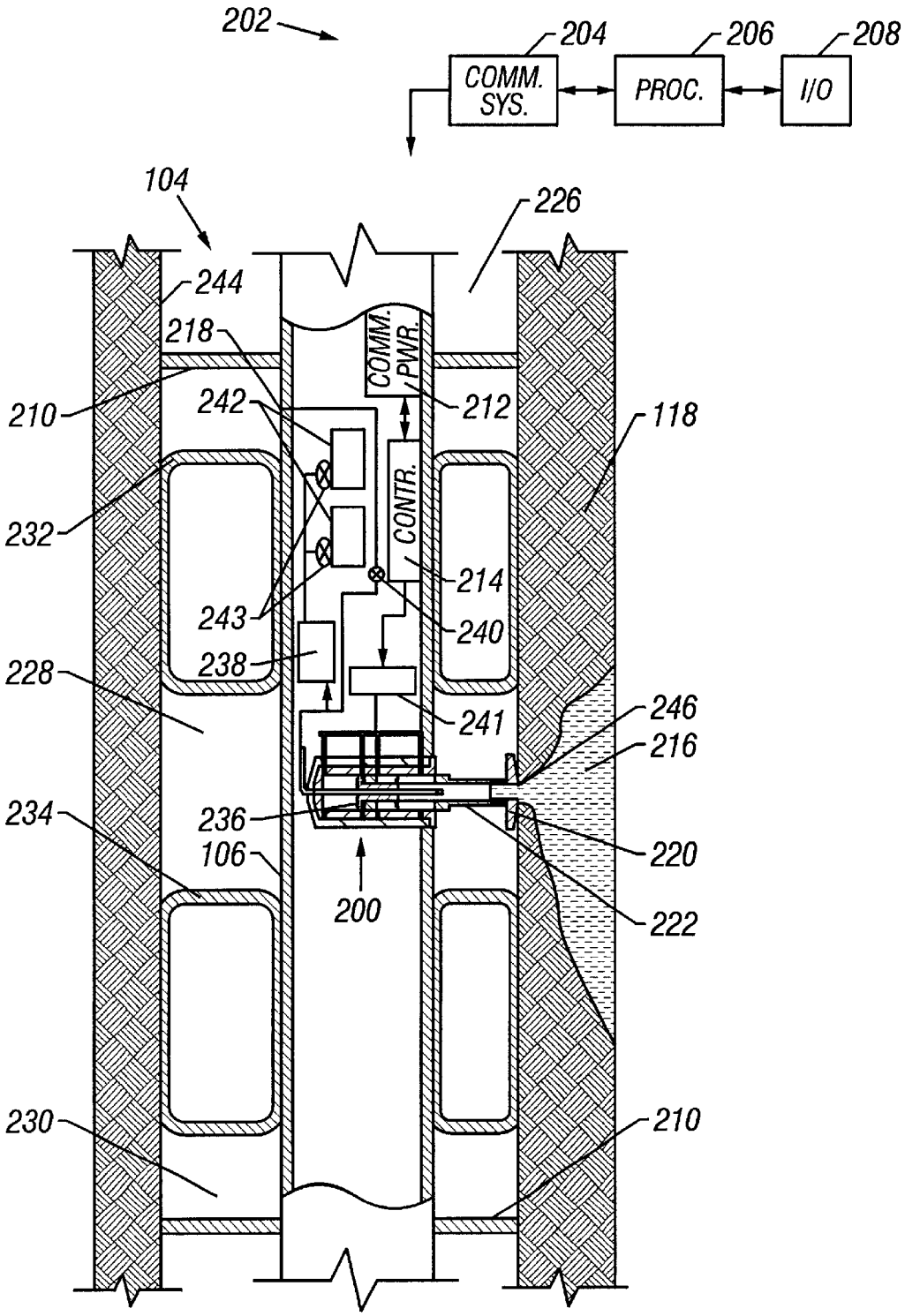
FIG. 2 shows a preferred embodiment of the present invention wherein downhole components are housed in a portion of drill string with a surface controller shown schematically.

FIG. 2 is a cross section elevation view of a preferred system according to the present invention. The system includes surface components and downhole components to carry out "Formation Testing While Drilling" (FTWD) operations. A borehole 104 is shown drilled into a formation 118 containing a formation fluid 216. Disposed in the borehole 104 is a drill string 106. The downhole components are conveyed on the drill string 106, and the surface components are located in suitable locations on the surface. A surface controller 202 typically includes a communication system 204 electronically connected to a processor 206 and an input/output device 208, all of which are well known in the art. The input/out device 208 may be a typical terminal for user inputs. A display such as a monitor or graphical user interface may be included for real time user interface. When hard-copy reports are desired, a printer may be used. Storage media such as CD, tape or disk are used to store data retrieved from downhole for future analyses. The processor 206 is used for processing (encoding) commands to be transmitted downhole and for processing (decoding) data received from downhole via the communication system 204. The surface communication system 204 includes a receiver for receiving data transmitted from downhole and transferring the data to the surface processor for evaluation recording and display. A transmitter is also included with the communication system 204 to send commands to the downhole components. Telemetry is typically relatively slow mud-pulse telemetry, so downhole processors are often deployed for preprocessing data prior to transmitting results of the processed data to the surface.

A known communication and power unit 212 is disposed in the drill string 106 and includes a transmitter and receiver for two-way communication with the surface controller 202. The power unit, typically a mud turbine generator, provides electrical power to run the downhole components. Alternatively, the power unit 212 may be a battery package or a pressurized chamber.

Connected to the communication and power unit 212 is a controller 214. As stated earlier, a downhole processor (not separately shown) is preferred when using mud-pulse telemetry; the processor being integral to the controller 214. The controller 214 uses preprogrammed commands, surface-initiated commands or a combination of the two to control the downhole components. The controller controls the extension of anchoring, stabilizing and sealing elements disposed on the drill string, such as grippers 210 and packers 232 and 234. The control of various valves (not shown) can control the inflation and deflation of packers 232 and 234 by directing drilling mud flowing through the drill string 106 to the packers 232 and 234. This is an efficient and well-known method to seal a portion of the annulus or to provide drill string stabilization while sampling and tests are conducted. When deployed, the packers 232 and 234 separate the annulus into an upper annulus 226, an intermediate annulus 228 and a lower annulus 230. The creation of the intermediate annulus 28 sealed from the upper annulus 226 and lower annulus 230 provides a smaller annular volume for enhanced control of the fluid contained in the volume.

The grippers 210, preferably have a roughened end surface for engaging the well wall 244 to anchor the drill string 106. Anchoring the drill string 106 protects soft components such as the packers 232 and 234 and pad member 220 from damage due to tool movement. The grippers 210 would be especially desirable in offshore systems such as the one shown in FIG. 1, because movement caused by heave can cause premature wear out of sealing components.

The controller 214 is also used to control a plurality of valves 241 combined in a multi-position valve assembly or series of independent valves. The valves 241 direct fluid flow driven by a pump 238 disposed in the drill string 106 to control a drawdown assembly 200. The drawdown assembly 200 includes a pad piston 222 and a drawdown piston or otherwise called a draw piston 236. The pump 238 may also control pressure in the intermediate annulus 228 by pumping fluid from the annulus 228 through a vent 218. The annular fluid may be stored in an optional storage tank 242 or vented to the upper 226 or lower annulus 230 through standard piping and the vent 218.

Mounted on the drill string 106 via a pad piston 222 is a pad member 220 for engaging the borehole wall 244. The pad member 220 is a soft elastomer cushion such as rubber. The pad piston 222 is used to extend the pad 220 to the borehole wall 244. A pad 220 seals a portion of the annulus 228 from the rest of the annulus. A port 246 located on the pad 220 is exposed to formation fluid 216, which tends to enter the sealed annulus when the pressure at the port 246 drops below the pressure of the surrounding formation 118. The port pressure is reduced and the formation fluid 216 is drawn into the port 246 by a draw piston 236. The draw piston 236 is integral to the pad piston 222 for limiting the fluid volume within the tool. The small volume allows for faster measurements and reduces the probability of system contamination from the debris being drawn into the system with the fluid. A hydraulic pump 238 preferably operates the draw piston 236. Alternatively, a mechanical or an electrical drive motor may be used to operate the draw piston 236.

It is possible to cause damage downhole seals and the borehole mudcake when extending the pad member 220, expanding the packers 232 and 234, or when venting fluid. Care should be exercised to ensure the pressure is vented or exhausted to an area outside the intermediate annulus 228. FIG. 2 shows a preferred location for the vent 218 above the upper packer 232. It is also possible to prevent damage by leaving the pad member 220 in a retracted position with the vent 218 open until the upper and lower packers 232 and 234 are set.

Figure 3:
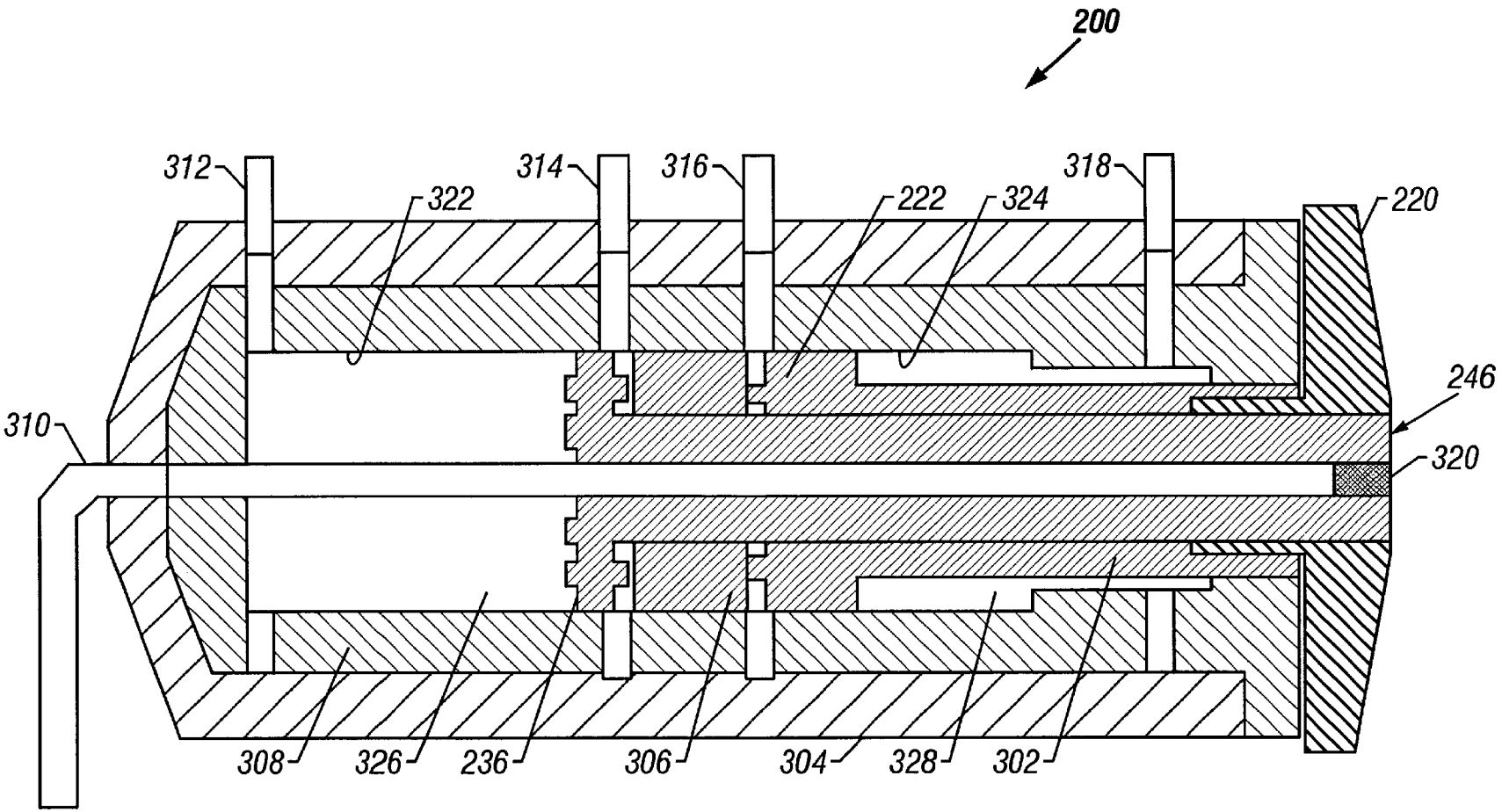
FIG. 3 is a detailed cross sectional view of an integrated pump and pad in an inactive state according to the present invention.

FIGS. 3 through 6 illustrate components of the drawdown assembly 200 in several operational positions. FIG. 3 is a cross sectional view of the fluid sampling unit of FIG. 2 in its initial, inactive or transport position. In the position shown in FIG. 3, the pad member 220 is fully retracted toward a tool housing 304. A sensor 320 is disposed at the end of the draw piston 236. Disposed within the tool housing 304 is a piston cylinder 308 that contains hydraulic oil or drilling mud 326 in a draw reservoir 322 for operating the draw piston 236. The draw piston 236 is coaxially disposed within the piston cylinder 308 and is shown in its outermost or initial position. In this initial position, there is substantially zero volume at the port 246. The pad extension piston 222 is shown disposed circumferentially around and coaxially with the draw piston 236. A barrier 306 disposed between the base of the draw piston 236 and the base of the pad extension piston 222 separates the piston cylinder 308 into an inner (or draw) reservoir 322 and an outer (or extension) reservoir 324. The separate extension reservoir 324 allows for independent operation of the extension piston 222 relative to the draw piston 236. The hydraulic reservoirs are preferably balanced to hydrostatic pressure of the annulus for consistent operation.

Referring to FIGS. 2 and 3, the drawdown assembly 200 has dedicated control lines 312–318 for actuating the pistons. The draw piston 236 is controlled in the "draw" direction by fluid 326 entering a "draw" line 314 while fluid 326 exits through a "flush" line 312. When fluid flow is reversed in these lines, the draw piston 236 travels in the opposite or outward direction. Independent of the draw piston 236, the pad extension piston 222 is forced outward by fluid 328 entering a pad deploy line 316 while fluid 328 exits a pad retract line 318. Like the draw piston 236, the travel of the pad extension piston 222 is reversed when the fluid 328 in the lines 316 and 318 reverses direction. As shown in FIG. 2, the downhole controller 214 controls the line selection, and thus the direction of travel, by controlling the valves 241. The pump 238 provides the fluid pressure in the line selected.

Figure 4:
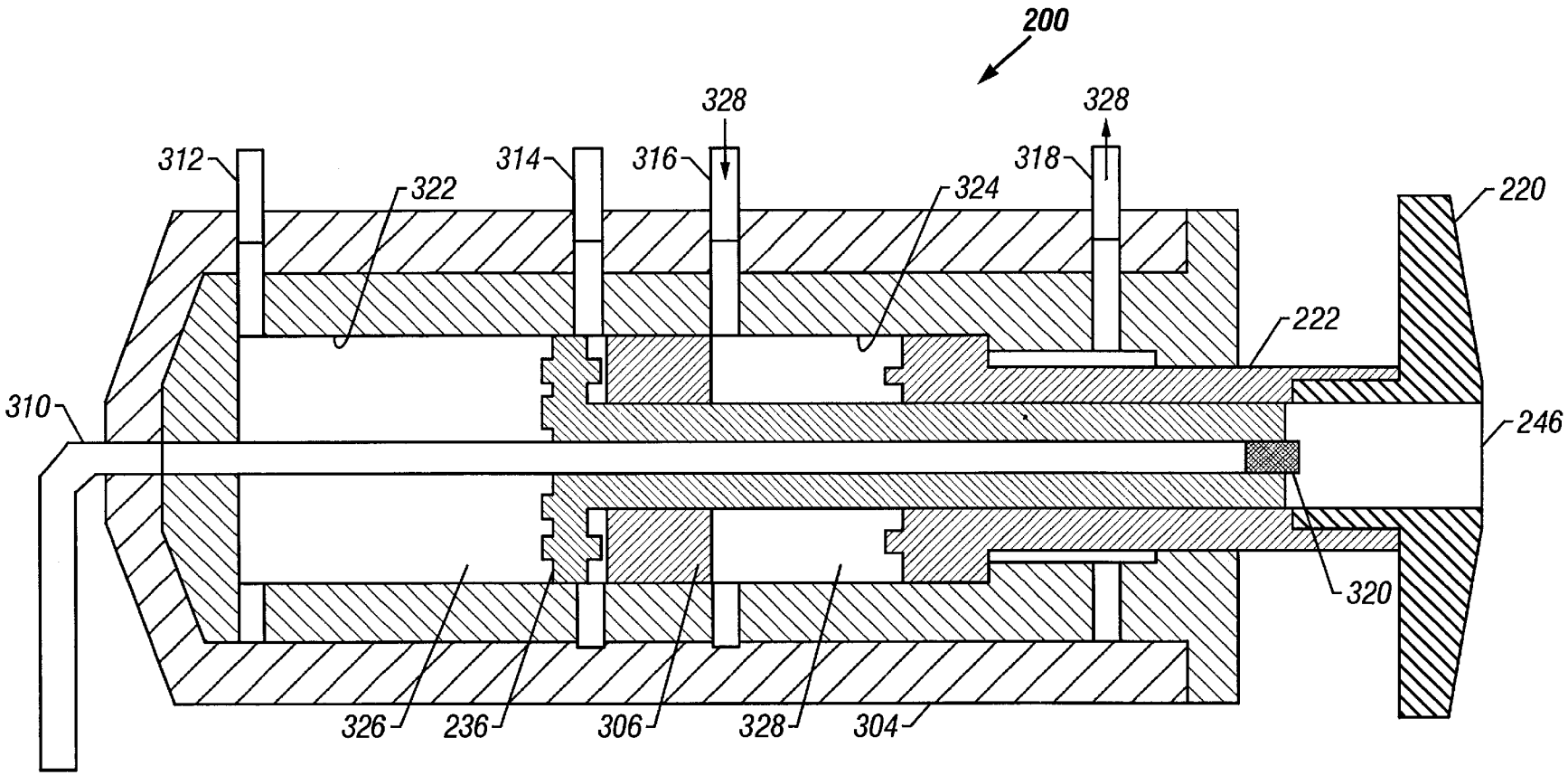
FIG. 4 is a cross sectional view of an integrated pump and pad showing an extended pad member according to the present invention.

Referring now to FIG. 4, the pad extension piston 222 of drawdown assembly 200 is shown at its outermost position. In this position, the pad 220 is in sealing engagement with the borehole wall 244. To get to this position, the pad extension piston 222 is forced radially outward and perpendicular to a longitudinal axis of the drill string 106 by fluid 328 entering the outer reservoir 324 through the pad deploy line 316. The port 246 located at the end of the pad 220 is open, and formation fluid 216 will enter the port 246 when the draw piston 236 is activated.

Test volume can be reduced to substantially zero in an alternate embodiment according to the present invention. Still referring to FIG. 4, if the sensor 320 is slightly reconfigured to translate with the draw piston 236, and the draw piston is extended to the borehole wall 244 with the pad piston 222 there would be zero volume at the port 246. One way to extend the draw piston 236 to the borehole wall 244 is to extend the housing assembly 304 until the pad 220 contacts the wall 244. If the housing 304 is extended, then there is no need to extend the pad piston 222. At the beginning of a test with the housing 304 extended, the pad 220, port 246, sensor 320, and draw piston 236 are all urged against the wall 244. Pressure should be vented to the upper annulus 226 via a vent valve 240 and vent 218 when extending elements into the annulus to prevent over pressurizing the intermediate annulus 228.

Another embodiment enabling the draw piston to extend does not include the barrier 306. In this embodiment (not shown separately), the flush line 312 is used to extend both pistons. The pad extension line 316 would then not be necessary, and the draw line 314 would be moved closer to the pad retract line 318. The actual placement of the draw line 314 would be such that the space between the base of the draw piston 236 and the base of the pad extension piston 222 aligns with the draw line 314, when both pistons are fully extended.

Figure 5:
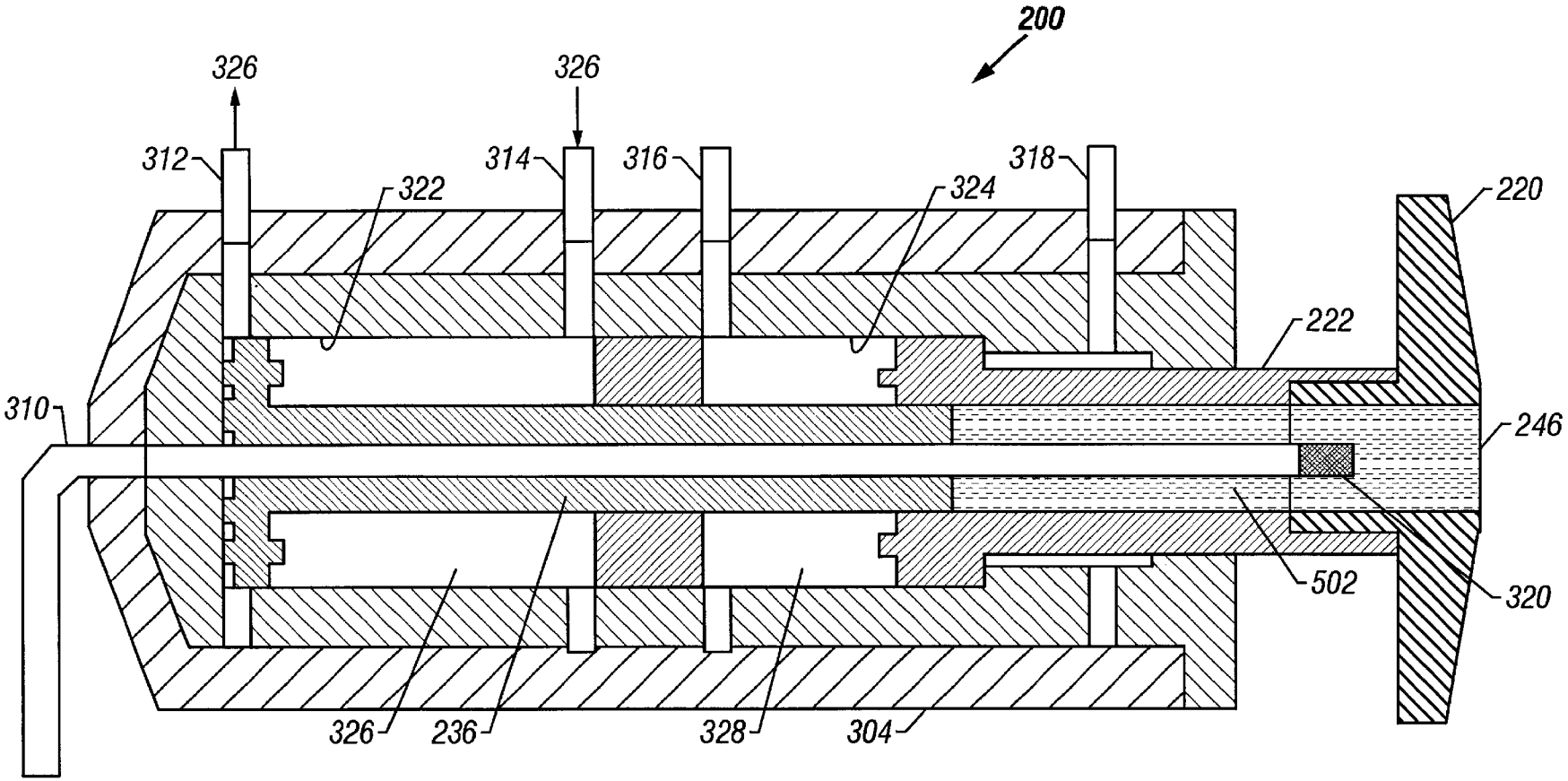
FIG. 5 is a cross sectional view of an integrated pump and pad after a pressure test according to the present invention.

Referring now to FIG. 5, a cross-sectional view of the drawdown assembly 200 is shown after sampling. Formation fluid 216 is drawn into a sampling reservoir 502 when the draw piston 236 moves inward toward the base of the housing 304. As described earlier, movement of the draw piston 236 toward the base of the housing 304 is accomplished by hydraulic fluid or mud 326 entering the draw reservoir 322 through the draw line 314 and exiting through the flush line 312. Clean fluid, meaning formation fluid 216 substantially free of contamination by drilling mud, can be obtained with several draw-flush-draw cycles. Flushing, which will be described in detail later, may be required to obtain clean fluid for sample purposes. The present invention, however, provides sufficiently clean fluid in the initial draw for testing purposes.

Fluid drawn into the system may be tested downhole with one or more sensors 320, or the fluid may be pumped through valves 243 to optional storage tanks 242 for retrieval and surface analysis. The sensor 320 may be located at the port 246, with its output being transmitted or connected to the controller 214 via a sensor tube 310 as a feedback circuit. The controller may be programmed to control the draw of fluid from the formation based on the sensor output. The sensor 320 may also be located at any other desired suitable location in the system. If not located at the port 246, the sensor 320 is preferably in fluid communication with the port 246 via the sensor tube 310.

Figure 6:
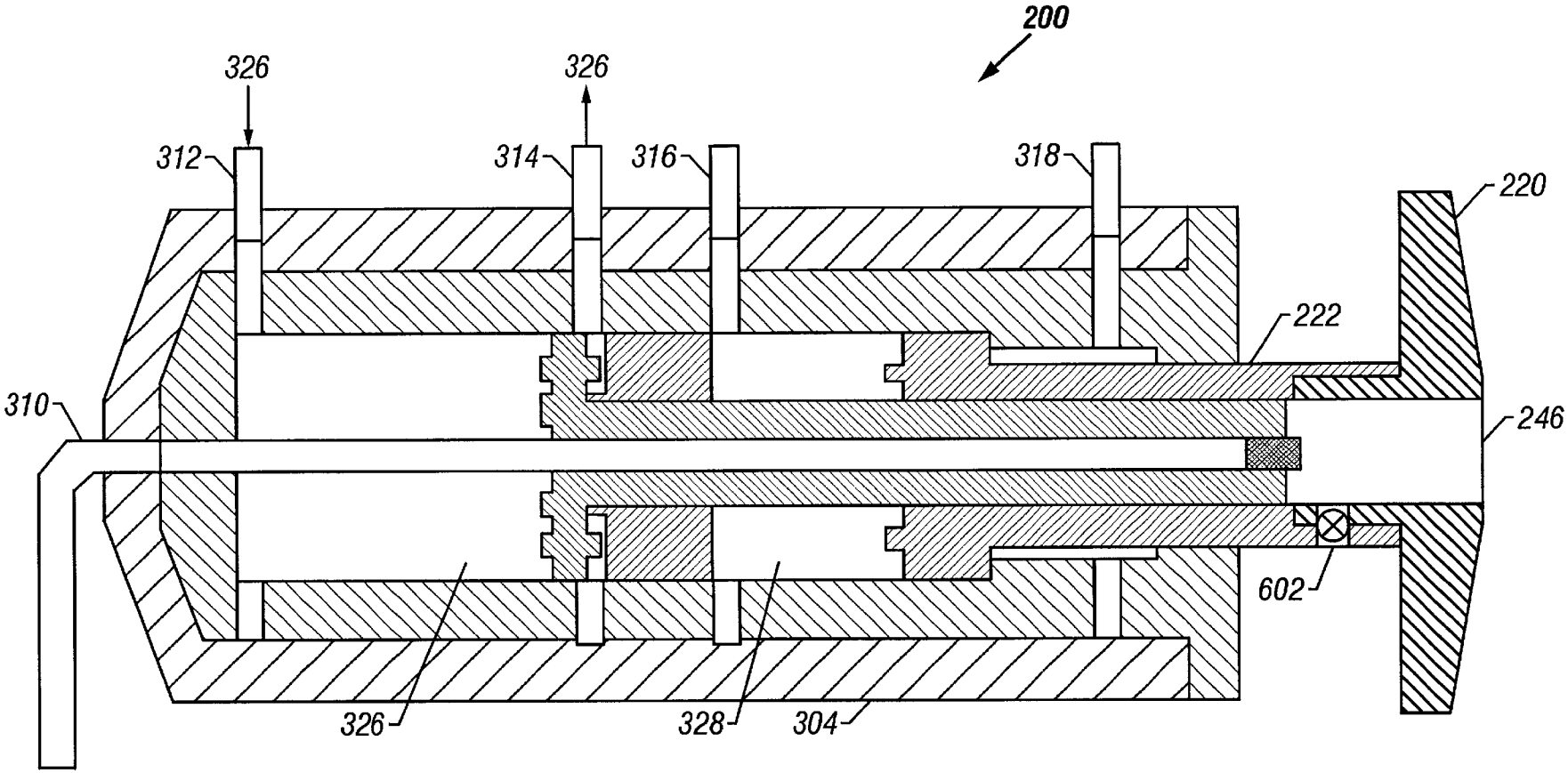
FIG. 6 is a cross sectional view of an integrated pump and pad after flushing the system according to the present invention.

Referring to FIGS. 2 and 6, a cross sectional view of the drawdown assembly 200 is shown after flushing the system. The system draw piston 236 flushes the system when it is returned to its pre-draw position or when both pistons 222 and 236 are returned to the initial positions. The translation of the fluid piston 236 to flush the system occurs when fluid 326 is pumped into the draw reservoir through the flush line 312. Formation fluid 216 contained in the sample reservoir 502 is forced out of the reservoir as shown in FIG. 5. A check valve 602 may be used to allow fluid to exit into the annulus 228, or the fluid may be forced out through the vent 218 to the annulus 226.

Figure 7:
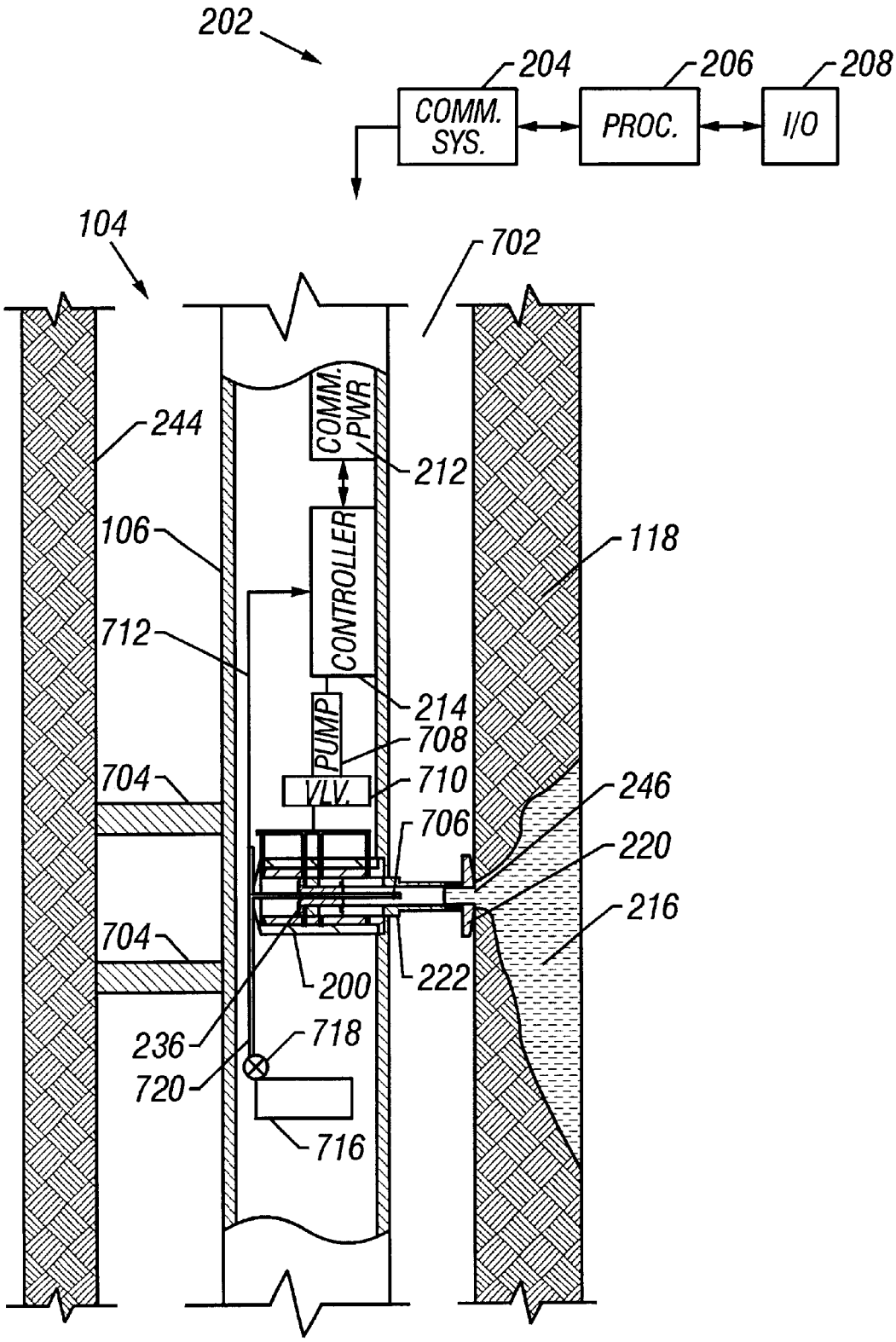
FIG. 7 shows an alternate embodiment of the present invention wherein packers are not required.

FIG. 7 shows an alternative embodiment of the present invention wherein packers are not required and the optional storage reservoirs are not used. A drill string 106 carries downhole components comprising a communication/power unit 212, controller 214, pump 708, a valve assembly 710, stabilizers 704, and a drawdown assembly 200. A surface controller sends commands to and receives data from the downhole components. The surface controller comprises a two-way communications unit 204, a processor 206, and an input-out device 208.

In this embodiment, stabilizers or grippers 704 selectively extend to engage the borehole wall 244 to stabilize or anchor the drill string 106 when the drawdown assembly 200 is adjacent a formation 118 to be tested. A pad extension piston 222 extends in a direction generally opposite the grippers 704. The pad 220 is disposed on the end of the pad extension piston 222 and seals a portion of the annulus 702 at the port 246. Formation fluid 216 is then drawn into the drawdown assembly 200 as described above in the discussion of FIGS. 4 and 5. Flushing the system is accomplished as described above in the discussion of FIG. 6.

The configuration of FIG. 7 shows a sensor 706 disposed in the fluid sample reservoir of the drawdown assembly 200. The sensor senses a desired parameter of interest of the formation fluid such as pressure, and the sensor transmits data indicative of the parameter of interest back to the controller 214 via conductors, fiber optics or other suitable transmission conductor. The controller 214 further comprises a controller processor (not separately shown) that processes the data and transmits the results to the surface via the communications and power unit 212. The surface controller receives, processes and outputs the results described above in the discussion of FIGS. 1 and 2.

The embodiment shown in FIG. 7 also includes a secondary tank 716 coupled to the drawdown assembly 200 via a flowline 720 and a valve 718. The tank is used when additional system volume is desirable. Additional system volume is desirable, for example, when determining fluid compressibility.

The valve 718 is a switchable valve controlled by the downhole controller 214. The use of the switchable valve 718 enables faster formation tests by allowing for smaller system volume when desired. For example, determinations of mobility and formation pressure do not require the additional volume of the secondary tank 716. Moreover, having smaller system volume decreases test time.

Modifications to the embodiments described above are considered within scope of this invention. Referring to FIG. 2 for example, the draw piston 236 and pad piston 222 may be operated electrically, rather than hydraulically as shown. An electrical motor, such as a spindle motor or stepper motor, can be used to reciprocate each piston independently, or preferably, one motor controls both pistons. Spindle and stepper motors are well known, and the electrical motor could replace the pump 238 shown in FIG. 2. If a controllable pump power source such as a spindle or stepper motor is selected, then the piston position can be selectable throughout the line of travel. This feature is preferable in applications where precise control of system volume is desired.

Using either a stepper motor or a spindle motor, the selected motor output shaft is connected to a device for reciprocating the pad and draw pistons 222 and 236. A preferred device is a known ball screw assembly (BSA). A BSA uses circulating ball bearings (typically stainless steel or carbon) to roll along complementary helical groves of a nut and screw subassembly. The motor output shaft may turn either the nut or screw while the other translates linearly along the longitudinal axis of the screw subassembly. The translating component is connected to a piston, thus the piston is translated along the longitudinal axis of the screw subassembly axis.

Now that system embodiments of the invention have been described, a preferred method of testing a formation using the preferred system embodiment will be described. Referring first to FIGS. 1–6, a tool according to the present invention is conveyed into a borehole 104 on a drill string 106. The drill string is anchored to the well wall using a plurality of grippers 210 that are extended using methods well known in the art. The annulus between the drill string 106 and borehole wall 244 is separated into an upper section 226, an intermediate section 228 and a lower section 230 using expandable packers 232 and 234 known in the art. Using a pad extension piston 222, a pad member 220 is brought into sealing contact with the borehole wall 244 preferably in the intermediate annulus section 228. Using a pump 238, drilling fluid pressure in the intermediate annulus 228 is reduced by pumping fluid from the section through a vent 218. A draw piston 236 is used to draw formation fluid 216 into a fluid sample volume 502 through a port 246 located on the pad 220. At least one parameter of interest such as formation pressure, temperature, fluid dielectric constant or resistivity is sensed with a sensor 320, and a downhole processor processes the sensor output. The results are then transmitted to the surface using a two-way communications unit 212 disposed downhole on the drill string 106. Using a surface communications unit 204, the results are received and forwarded to a surface processor 206. The method further comprises processing the data at the surface for output to a display unit, printer, or storage device 208.

A test using substantially zero volume can be accomplished using an alternative method according to the present invention. To ensure initial volume is substantially zero, the draw piston 236 and sensor are extended along with the pad 220 and pad piston 222 to seal off a portion of the borehole wall 244. The remainder of this alternative method is essentially the same as the embodiment described above. The major difference is that the draw piston 236 need only be translated a small distance back into the tool to draw formation fluid into the port 246 thereby contacting the sensor 320. The very small volume reduces the time required for the volume parameters being sensed to equalize with the formation parameters.

Figure 8:
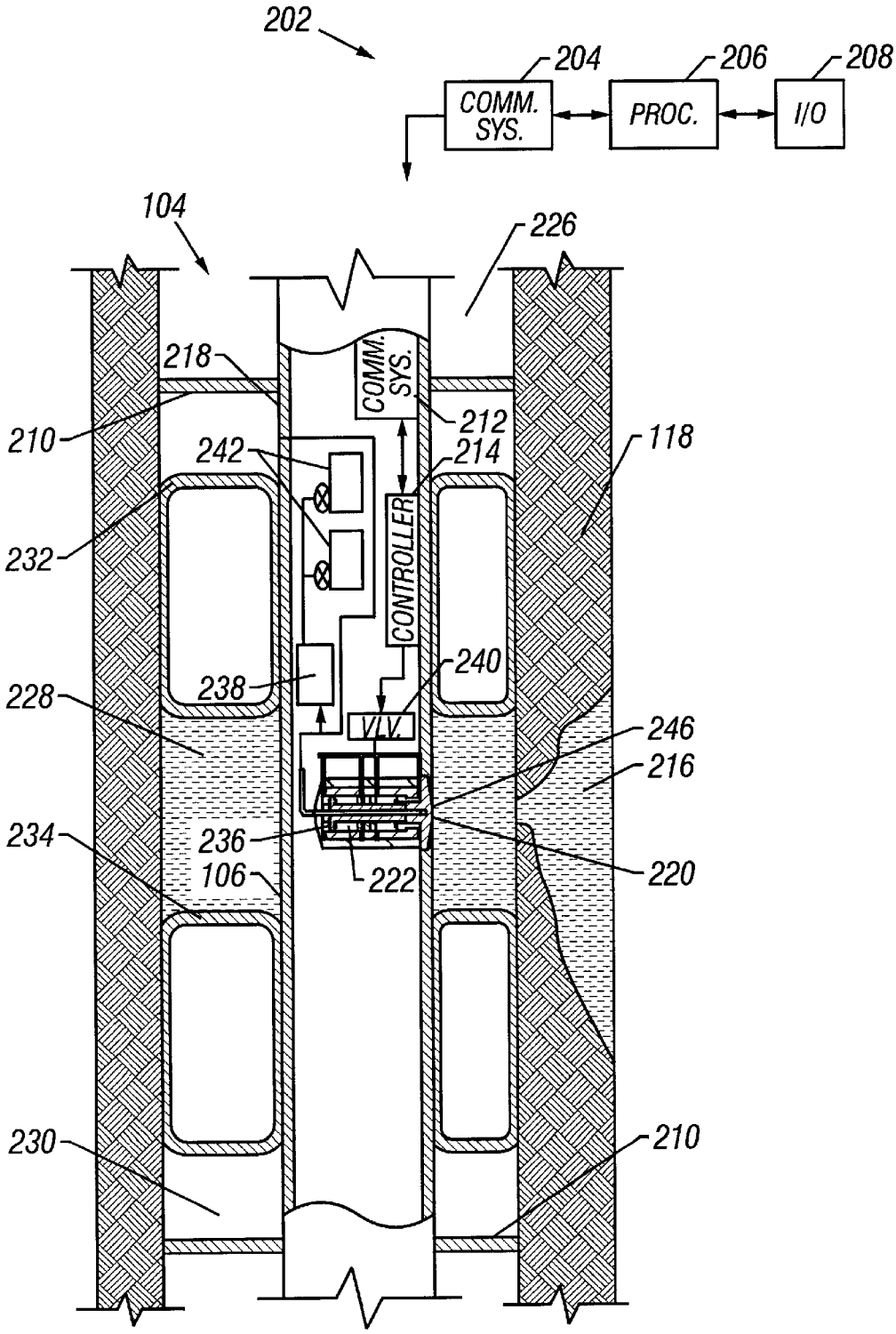
FIG. 8 shows and alternate mode of operation of a preferred embodiment wherein samples are taken with the pad member in a retracted position.

FIG. 8 illustrates another method of operation wherein samples of formation fluid 216 are taken with the pad member 220 in a retracted position. The annulus is separated into the several sealed sections 226, 228 and 230 as described above using expandable packers 232 and 234. Using a pump 238, drilling fluid pressure in the intermediate annulus 228 is reduced by pumping fluid from the section through a vent 218. With the pressure in the intermediate annulus 228 lower than the formation pressure, formation fluid 216 fills the intermediate annulus 228. If the pumping process continues, the fluid in the intermediate annulus becomes substantially free of contamination by drilling mud. Then without extending the pad member 220, the draw piston 236 is used to draw formation fluid 216 into a fluid sample volume 502 through a port 246 exposed to the fluid 216. At least one parameter of interest such as those described above is sensed with a sensor 320, and a downhole processor processes the sensor output. The processed data is then transmitted to the surface controller 202 for further processing and output as described above.

A method of evaluating a formation using a probe with small system volume is provided in another embodiment of the present invention. The method includes using a tool with small system volume, such as the drawdown assembly 200 described above and shown in FIGS. 1–7.

The method includes sealing a portion of a well borehole wall with the extendable drawdown assembly 200 as described. In a preferred method, the system volume of the tool is then increased using the draw piston 236. Once the system pressure is drawn below the formation pressure, the piston draw rate is adjusted. The draw rate is adjusted in steps, and a plurality of measurements are taken at each step. This stepwise drawdown is illustrated in FIG. 9.

Figure 9:
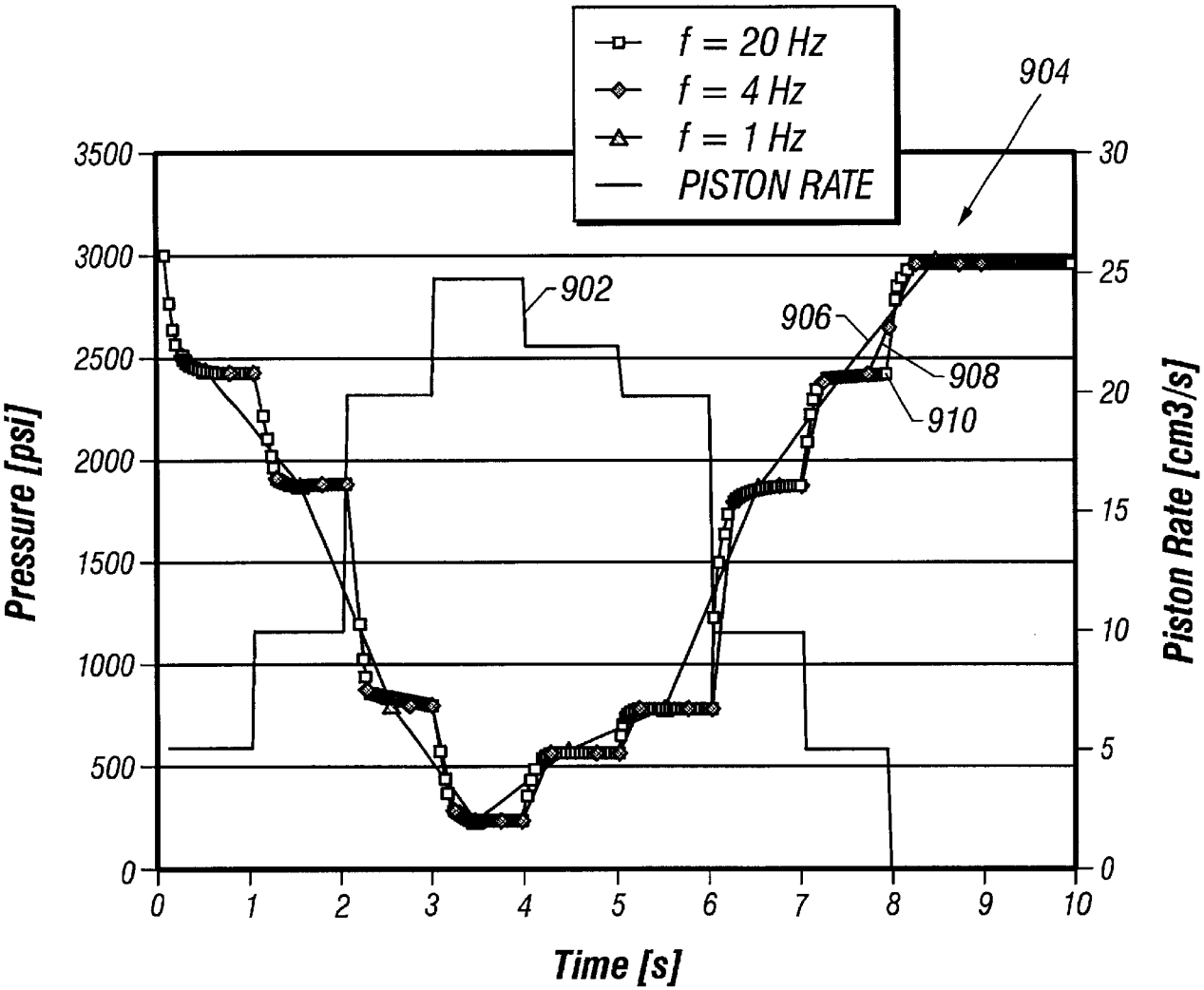
FIG. 9 shows a plot illustrating a method according to the present invention.

FIG. 9 is a plot representing a single cycle of a drawdown test using the method of the present invention. One curve 902 represents piston draw rate of the draw piston 236 or simply piston rate, which is measured in cubic centimeters per second (cm3/s). A set of other curves 904 represents pressure response of the system volume or test volume influenced by fluid flow from the formation. The pressure response is measured in pounds per square inch (psi).

The pressure response curves 904 comprise separate curves 906, 908 and 910 determined using data rates of 1 Hz, 4 Hz and 20 Hz, respectively. In most applications using the method, data rate of 4 Hz or higher is preferred to ensure multiple data points are available for the multiple regression analysis. The data rate used, however, may vary below 4 Hz when well conditions allow.

The method of the present invention enables determinations of mobility (m), fluid compressibility (C) and formation pressure (p*) to be made during the drawdown portion of the cycle by varying the draw rate of the system during the drawdown portion. This early determination allows for earlier control of drilling system parameters based on the calculated p*, which improves overall system performance and control quality.

For formations having low mobility, the method may be concluded at the end of the drawdown portion. A desirable feature of the method is the added ability to vary buildup rates on the latter portion of the drawdown/build up cycle i.e., the build up portion. Determinations of m and p* at this point improves the accuracy of the overall determination of the parameters. This added determination, may only be desirable for formations having relatively low mobility, and this aspect of the present invention is optional.

For determining mobility (m), C is not used in the calculations. Therefore, C need not be assumed as in previous methods of determining m, and the determination becomes more accurate. Additionally, the determination of m does not rely on system volume, thus enabling the use of a small-volume system such as the system of the present invention. With the use of a highly accurate control system for controlling the draw rate, determining mobilities ranging from 0.1 to 2000 mD/cP is possible. In a preferred embodiment, a down hole micro-processor based controller 214 is used to control the draw rate.

If determining C is desirable, the determination may be made using a system according to the present invention. Referring now to FIG. 7, one embodiment of the system of the present invention includes a separate tank 716 that is connected to the system volume. The tank 716 is coupled to the system volume by a flow line 720 and having a valve 718. The controller 214 actuates the valve 718 to switch the valve from a closed position to an open position thereby increasing the overall system volume by adding the tank volume to the system volume for the purpose of calculating C.

The larger system volume is necessary only for determining C. In all other determinations, C is not necessary and the system volume may be switched to include only its volume of the drawdown assembly 200 by using the switching valve 718. Using the smaller system volume enables faster system response to varying draw rates. In a preferred embodiment, the system volume is variable between 0 $cm^3$ and 1000 $cm^3$.

FIG. 9 shows that the system pressure will substantially stabilize at a given piston rate, even though the test volume is changing. And having a data rate sufficient for acquiring at least two measurements at each given piston rate, the method then utilizes Formation Rate Analysis (FRA) to determine desired formation parameters such as fluid compressibility, mobility and formation pressure.

U.S. Pat. No. 5,708,204 to Kasap, which is incorporated herein by reference, describes FRA. FRA provides extensive analysis of pressure drawdown and build-up data. The mathematical technique employed in FRA is called multi-variant regression. Using multi-variant regression calculations, parameters such as formation pressure (p*), fluid compressibility (C) and fluid mobility (m) can be determined simultaneously when data representative of the build up process are available.

Equation 1 represents the FRA mathematically.

$$p(t) = p^* - \left(\frac{\mu}{kG_0 r_i}\right)\left(C_{sys}V_{sys}\frac{dp}{dt} + q_{dd}\right) \quad \text{Equation 1}$$

where, p(t) is the system pressure as a function of time; p* is the formation pressure as a calculated value; $k/\mu$ is mobility; $G_0$ is a dimensionless geometric factor; $r_i$ is the inner radius of the port 246; $C_{sys}$ is the compressibility of fluid in the system; $V_{sys}$ is the total system volume; dp/dt is the pressure gradient within the system with respect to time; and $q_{dd}$ is the draw down rate.

By rearranging Equation 1 and using the time-derivative of dp/dt terms, the equation becomes:

$$p(t) = p^* - \frac{\mu C_{sys}V_{sys}}{kG_0 r_i}\frac{dp(t)}{dt} - \frac{\mu}{kG_0 r_i}q_{dd} \quad \text{Equation 2}$$

wherein dp(t)/dt is the pressure change rate at time t and $q_{dd}$ is the draw down rate. These terms are the only variables. Equation 2 is in the mathematical form of a linear equation $y=b-m_1x_1-m_2x_2$, which can be solved using multiple regression analysis techniques to determine the coefficients m1 and m2. Determining m1 and m2 then leads to determining mobility $k/\mu$ and compressibility $C_{sys}$ when desired.

The method of the present invention provides a faster evaluation of formations by using variable rates of piston drawdown and pressure build up enabled by the various embodiments of the apparatus according to the present invention.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. A method for determining at least one parameter of interest of a formation while drilling, the method comprising:

(a) conveying a tool on a drill string into a borehole traversing the formation;

(b) extending at least one selectively extendable probe disposed on the tool to make sealing engagement with a portion of the formation;

(c) exposing a port to the sealed portion of the formation, the port providing fluid communication between the formation and a first volume within the tool;

(d) varying the first volume with a volume control device using a plurality of volume change rates;

(e) determining at least one characteristic of the first volume using a test device at least twice during each of the plurality of volume change rates; and (f) using multiple regression analysis to determine the at least one parameter of interest of the formation using the at least one characteristic determined during the plurality of volume change rates.

2. The method of claim 1, wherein using multiple regression analysis further comprises using multi-variant linear regression analysis.

3. The method of claim 1, wherein the determined characteristic is flow rate and using multiple regression analysis further comprises using FRA.

4. The method of claim 1, wherein the at least one determined characteristic is selected from a group consisting of (i) pressure and (ii) temperature.

5. The method of claim 1, wherein the at least one determined parameter of interest is at least one of formation fluid mobility, formation fluid compressibility, and formation pressure.

6. The method of claim 1, wherein varying the first volume further comprises varying the first volume between zero and 1000 cubic centimeters.

7. The method of claim 1, wherein the tool includes a tank having a second volume selectively coupled to the first volume, the method further comprising:

(i) adding the second volume to the first volume such that the determined first volume characteristic is influenced by the second volume; and (ii) using multiple regression analysis to determine formation fluid compressibility using the determined characteristic of the combined first and second volumes.

8. A method for determining at least one parameter of interest of a formation while drilling, the method comprising:

(a) conveying a tool on a drill string into a borehole traversing the formation;

(b) extending at least one selectively extendable probe disposed on the tool to make sealing engagement with a portion of the formation;

(c) exposing a port to the sealed portion of the formation, the port providing fluid communication between the formation and a first volume within the tool, the first volume being selectively variable between zero cubic centimeters and 1000 cubic centimeters;

(d) varying the first volume with a volume control device using a plurality of volume change rates;

(e) determining at least one characteristic of the first volume using a test device at least twice during each of the plurality of volume change rates; and (f) determining the at least one parameter of interest of the formation using the at least one characteristic determined during the plurality of volume change rates.

9. The method of claim 8, wherein determining at least one parameter of interest is performed using multiple regression analysis.

10. The method of claim 8, wherein determining the at least one parameter of interest is performed using multivariant linear regression analysis.

11. The method of claim 8, wherein determining the at least one parameter of interest is performed using FRA.

12. The method of claim 8, wherein the at least one determined characteristic is selected from a group consisting of (i) pressure and (ii) temperature.

13. The method of claim 8, wherein the at least one determined parameter of interest is at least one of formation fluid mobility, formation fluid compressibility, and formation pressure.

14. The method of claim 8, wherein the tool includes a tank defining a second volume, the tank being selectively coupled to the first volume, the method further comprising:

(i) adding the second volume to the first volume such that the determined first volume characteristic is influenced by the second volume; and (ii) determining formation fluid compressibility using the determined characteristic of the combined first and second volumes.

* * * * *